US005788779A

United States Patent [19]

Marchisseau et al.

[11] Patent Number: 5,788,779

[45] Date of Patent: Aug. 4, 1998

[54] CHEMICAL CLEANING METHOD FOR A CLUTCH FRICTION LINER SUPPORT DISC, A WORKSTATION FOR CARRYING OUT THE METHOD, AND AN INSTALLATION INCLUDING SUCH A WORKSTATION FOR ADHESIVELY FASTENING FRICTION LINERS ON A SUPPORT DISC

[75] Inventors: Michel Marchisseau, Limoges; Luc Federzoni, Vicq sur Breuilh, both of France

[73] Assignee: Valeo, Paris, France

[21] Appl. No.: 760,778

[22] Filed: Dec. 5, 1996

[30] Foreign Application Priority Data

Dec. 7, 1995 [FR] France ..... 95 14501

[51] Int. Cl.[6] ..... B24B 31/00

[52] U.S. Cl. ..... 134/2; 134/3; 134/28; 451/103; 438/4

[58] Field of Search ..... 134/2, 3, 28; 451/103; 438/4

[56] References Cited

FOREIGN PATENT DOCUMENTS

| | | |
|---|---|---|
| 579554 | 12/1995 | European Pat. Off. . |
| 1360811 | 4/1964 | France . |
| 2164139 | 7/1973 | France . |

*Primary Examiner*—John Kight
*Assistant Examiner*—Everett White
*Attorney, Agent, or Firm*—Morgan & Finnegan, L.L.P.

[57] ABSTRACT

A motor vehicle clutch has a friction wheel which includes a support disc, on which friction liners are attached by adhesive bonding to selected zones of the opposed faces of the support disc. These zones are prepared for application of the adhesive by subjecting them to selective scouring in which a liquid scouring agent is applied locally at selected points on each zone.

14 Claims, 3 Drawing Sheets

CHEMICAL CLEANING METHOD FOR A CLUTCH FRICTION LINER SUPPORT DISC, A WORKSTATION FOR CARRYING OUT THE METHOD, AND AN INSTALLATION INCLUDING SUCH A WORKSTATION FOR ADHESIVELY FASTENING FRICTION LINERS ON A SUPPORT DISC

FIELD OF THE INVENTION

The present invention relates primarily to a method for preparing a metal support disc for the fastening, by adhesive bonding on the latter, of clutch friction liners, this preparation taking the form of chemical cleaning or scouring of the support disc. The invention also relates to production apparatus for carrying out such a method, comprising a workstation at which the cleaning operation is carried out; and an installation, including such a workstation, for the adhesive attachment of clutch friction liners on a friction disc.

BACKGROUND OF THE INVENTION

French patent specification No. FR 2 164 139A is an example of a document which teaches the fastening of friction liners by adhesive bonding on either side of a metallic support disc, in particular a support disc forming part of a clutch friction wheel for a motor vehicle clutch. In this known method, adhesive is deposited hot on the metal support disc and/or on the friction liners, after which the liners are put into a press; and finally the disc is heated, for which purpose heating means are provided.

Prior to the operation in which the adhesive is applied (either directly on the metallic support disc or only on the friction liners), it is necessary to carry out a cleaning or scouring operation on the opposed surfaces of the support disc, in order to degrease them and/or to give them a surface condition which displays a slight amount of roughness.

In one known technique, scouring can be carried out by mechanical scouring, for example by sand blasting. Such a process is particularly expensive to carry out, to the extent that it requires a sand blasting installation to be provided. In addition, new regulations relating to industrial installations have the effect of progressively eliminating sand blasting installations, which are very detrimental both to hygiene and to personnel safety.

In the context of mechanical cleaning or scouring, it has been proposed to replace sand blasting with projection of carborundum powder of the kind that is used as an abrasive. However, this method is also expensive, because the abrasive material used cannot be recycled; and it still requires a production facility of a kind suitable for application of carborundum powder.

A further method for giving a slight degree of roughness to the surfaces on which adhesive is to be applied consists in subjecting them to chemical cleaning or scouring, which also provides degreasing of these surfaces. The chemical cleaning agent may for example be a solution of phosphoric acid and methyl alcohol, in the case where the metallic support disc is of steel.

In one known technique, the metallic support discs are submerged entirely in a bath of the acid cleaning solution. The cleaning apparatus that uses immersion in a bath is of a particular complexity, because the safety measures that have to be taken in order to incorporate such an apparatus in an industrial environment are very extensive. In addition, as the immersion operations proceed, the chemical characteristics of the bath become modified, and the quality of the cleaning obtained varies over the course of time. In this connection, in order to reduce the overall consumption of the acid cleaning agent, this agent, contained in the bath, is not continuously renewed. In all of the cleaning or scouring methods which have been mentioned above, it is necessary to carry out the cleaning or scouring operations at a specific workstation upstream of the other steps (in the process of fastening the friction liners by adhesive bonding), by treating the metallic support discs in batches. The cleaned support discs then have to be stored before the subsequent operations of applying adhesive and fixing the liners on the support discs are carried out. During this storage, and then later on during use, the portions of the opposed surfaces of the metallic support discs which have been cleaned or scoured, and which do not constitute adhesion zones covered by the friction liners, are extremely liable to become corroded.

DISCUSSION OF THE INVENTION

An object of the present invention is to propose a novel method of chemical cleaning or scouring which overcomes the above mentioned drawbacks.

According to the invention in a first aspect, a method for the chemical cleaning or scouring of a metallic support disc, for supporting friction liners secured by adhesive bonding on the support disc, especially for a motor vehicle clutch friction wheel, the support disc having on its opposed faces zones which are adapted to receive adhesive, is characterized in that the said zones are subjected to selective cleaning or scouring by localized application of a liquid cleaning or scouring agent.

The cleaning or scouring agent is preferably applied in the form of a drop which is held hydrodynamically in contact with the said zone to be cleaned or scoured. The cleaning agent is preferably applied in the form of a series of successive drops.

Alternatively, in a method according to the invention the cleaning agent may be applied by localized projection of a fine cleaning jet of low mass flow, and by sucking the cleaning agent away from the periphery of the said zone.

In a further embodiment of the invention, the cleaning or scouring agent constitutes the electrolyte in an electrolytic cleaning or scouring method in which the metallic support disc is one of the two electrodes, and in which the cleaning or scouring agent is brought close to the said zone through an inlet tube, the end of which constitutes the other electrode, preferably the cathode.

According to the invention in a second aspect, a workstation, for carrying out a method according to the said first aspect of the invention at the workstation, is characterized in that it comprises at least one inlet tube for delivering a liquid cleaning or scouring agent, and means for recovering the said agent by suction.

The recovery means preferably include an annular suction port coaxial with the inlet tube.

The workstation preferably includes means for displacing the support disc or workpiece by rotation with respect to the inlet tube, for the purpose of cleaning or scouring the various zones on one face of the metallic support disc. The workstation may include a plurality of inlet tubes arranged in a pattern corresponding to the pattern of selected ones of the said zones.

According to another preferred feature of the invention, in a workstation according to the invention, a plate having at least one through aperture is placed between the workpiece and the top face of a body member constituting a workstation. This plate may be flexible, and the through aperture is preferably arranged in line with an inlet tube of the workstation.

According to the invention in a third aspect, an installation for the adhesive fastening of friction liners on to a metallic support disc is characterised in that it includes at least one cleaning or scouring station according to the said second aspect of the invention, arranged upstream of an adhesive bonding station.

Further features and advantages of the invention will appear more clearly on a reading of the following detailed description of some preferred embodiments of the invention, given by way of non-limiting example only and with reference to the accompanying drawings.

DESCRIPTION OF PREFERRED EMBODIMENTS OF THE INVENTION

Figure 2:
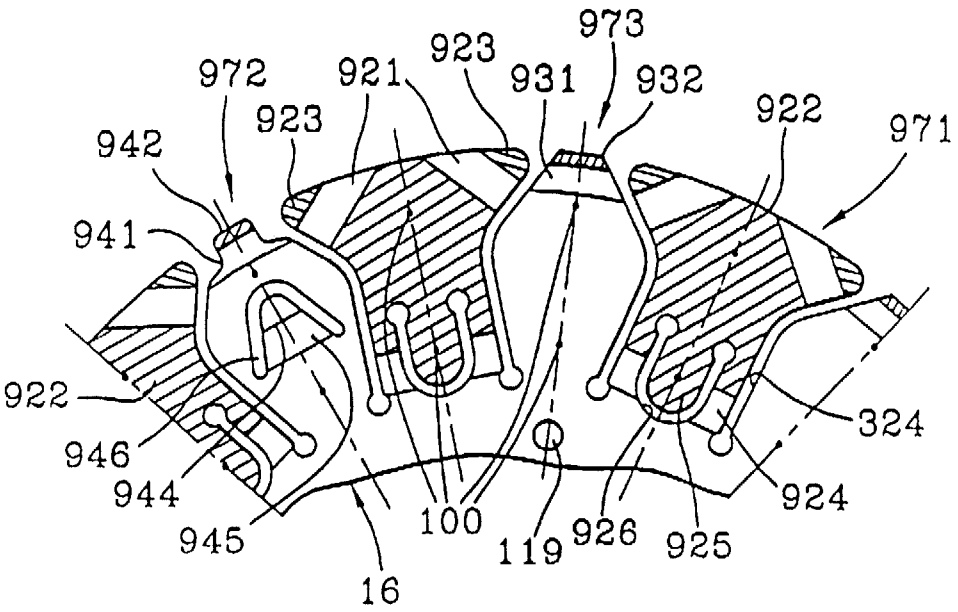
FIG. 2 shows part of the outer peripheral region of a support disc on which the friction liners are arranged to be secured by adhesive bonding.
Figure 1:
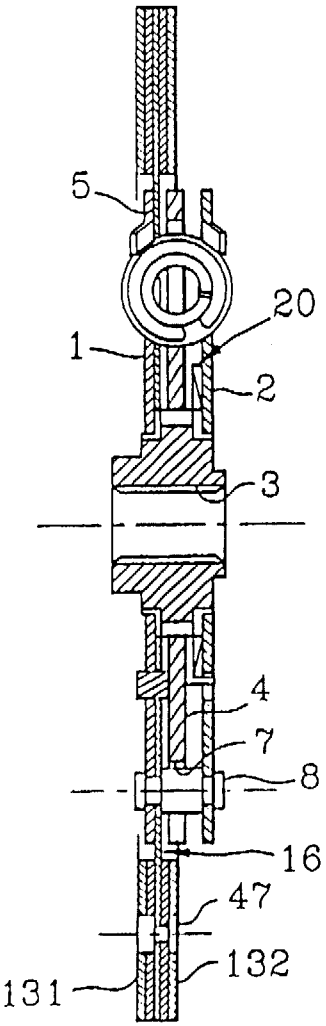
FIG. 1 is a view in axial cross section of a clutch friction wheel having a support disc and two friction liners which are secured on the support disc by riveting.

FIGS. 1 and 2 show a clutch friction wheel with its support disc 16. In the known way, the clutch friction wheel comprises an input part 16, 131, 132, which is coupled to an output part 3. In use, the input part 16, 131, 132 is arranged to be gripped between the pressure plate and reaction plate (not shown) of a clutch. The pressure and reaction plates are coupled to a driving shaft, which in the case of a clutch for a motor vehicle usually consists of the output end of the engine crankshaft. This coupling to the crankshaft may be an elastic coupling when the reaction plate is in two parts, constituting a damped flywheel. The output part 3 usually consists of a hub, which is internally splined so that it can be coupled in rotation to a driven shaft, which in the case of a motor vehicle clutch is usually the input shaft of the gearbox of the vehicle.

The clutch is of the type which is normally in the engaged condition, in which the input part 16, 131, 132 is gripped between the pressure plate and the reaction plate, so that the driving torque from the engine is then transmitted from the crankshaft to the input shaft of the gearbox. In order to disengage the clutch, it is necessary to act with the aid of a clutch release bearing on the end of a declutching device which forms part of the clutch. This declutching device is typically a diaphragm, and the clutch release bearing deflects the diaphragm so as to cancel the gripping action and to release the input part 16, 131, 132.

The input part may be rigidly coupled to the output part 3, being for example secured by riveting on a radial plate or on a flange which is fixed to the hub 3. In a modified version, in order to provide good absorption of vibrations, the input part is coupled elastically to the output part 3.

For example, the input part 16, 131, 132 is fixed to two guide rings 1 and 2 which are arranged on either side of a damper plate 4. The damper plate 4 is fixed to the hub 3 that constitutes the output part or element, for rotation with the latter. This coupling may be of the loose coupling kind, in which there is relative rotation between the input and output parts, in order to take up an angular clearance, before the input and output parts rotate together. Circumferentially acting springs 9 are mounted in housings, usually in the form of windows, which are formed in facing relationship with each other in the guide rings 1 and 2 and in the damper plate 4. Axially acting resilient means 20 are also interposed between the guide rings 1 and 2 on the one hand and the damper plate 4 on the other.

Thus in a motor vehicle, the clutch is a device for making and breaking the coupling between the engine and the gearbox, and enables vibrations in the transmission train from the engine crankshaft to the road wheels of the vehicle to be absorbed. A further function is to improve the comfort of the occupants of the vehicle, by preventing any sudden shocks during re-engagement of the clutch.

Accordingly, the input part or element 16, 131, 132 of the clutch is of the progressive type, and is essentially resilient. The thickness of the input part is greater when the clutch is disengaged than when it is engaged. In practice, the input part of the clutch comprises a metallic support disc 16 which has a central portion and a peripheral portion, the latter being divided into resilient radial blades which are adapted to receive friction liners 131 and 132, the latter being secured on these blades. The blades have zones which are offset axially with respect to the central portion of the support disc 16, and the friction liners 131 and 132 are fastened on these offset zones. The central portion 16 of the support disc is for example, and as shown in FIG. 1, fixed to the guide rings 1 and 2 by means of short longitudinal spacer bars 8 which join the two guide rings 1 and 2 together securely, and which, for this purpose, extend through apertures 7 in the damper plate 4 with a circumferential clearance. In a modified version, the support disc 16 is fixed to one of the guide rings 1 or 2 by means of metallic rivets.

The friction liners 131 and 132 may be fixed on the support disc wholly or partly by means of rivets 47. For more detail in this connection, reference is invited for example to European patent specification No. EP 0 579 554A.

Thus, the blades are progressively squeezed during the action of engaging the clutch.

The disadvantage of fastening by riveting is an increase in the thickness of the liners 131 and 132, so that there will be a sufficiently great thickness of material between the outer face of the friction liner and the heads of the rivets 47. This leads to an increase in the inertia of the clutch friction wheel as a whole. For this reason, it is desirable to secure the friction liners directly on the support disc 16 by adhesive bonding.

In this connection, and as shown in FIG. 2, the support disc 16 may have at its outer periphery blades 971 arranged alternately with tongues 972 and 973, all of which are orientated generally radially. Each of the blades 971 has a central support zone 922 which is offset axially with respect to the central portion of the support disc 16, together with two peripheral support zones 923 which are disposed on either side of the central zone 922, being offset axially from the latter.

The central zone 922 of each blade 971 is joined to its peripheral support zones 923 by fold portions 921 which extend obliquely with respect to the radial axis of symmetry of the blade 971. A tangential fold portion 924, extending at right angles to the radial axis of symmetry of the blade 971, joins its central zone 922 to the central portion of the support disc 16. This central portion is formed with holes 119 for securing it by riveting to the guide ring 1 in FIG. 1.

The surface area of the central support zone of each blade 971 is enlarged by a tongue 925, which is defined within a U-shaped slot 926 that extends across the tangential fold portion 924. The friction liner 132, which is the one arranged to make contact with the pressure plate of the clutch, is secured on the central support zones 922 of the blades, while the other friction liner 131 is in contact with the peripheral support zones 923 of the blades. In this example, these peripheral support zones are in the same plane as the central portion of the support disc 16.

The tongues 972 and 973 comprise a main portion which lies in the same plane as the central portion of the support disc 16, and they serve for the fastening of the friction liner 131, the latter being arranged to make contact with the pressure plate of the clutch. In this connection, it should be noted that the reaction plate undergoes less deformation than the pressure plate under the effect of heat. The tongues 972 and 973 are separated from the blades 971 by slots 324.

Each of the tongues 972, 973 has at least one supplementary support zone 942, 932 respectively, which is offset axially with respect to the main portion of the corresponding tongue, so as to make contact with the friction liner 132 associated with the pressure plate. These supplementary zones 942 and 932 are joined through respective fold portions 941 and 931 to the main portions of the flexible tongues 972 and 973 respectively. The fold portions 941 and 931 lie at right angles to the radial axis of symmetry of the respective tongues. In addition, a supplementary support zone 944, which is directed axially towards the friction liner 132, may be formed by providing a slot 946 and a tangential fold portion 945, as is indicated in FIG. 2 in the tongue 972.

In this embodiment, therefore, the friction liners 132 and 131 respectively are secured directly be adhesive bonding on the central support zones of the blades 971, and on the main portions of the tongues 972 and 973 of the metallic support disc 16, so reducing the thickness of the friction liners and the inertia of the clutch friction wheel as a whole.

For this purpose, and in a manner known per se, the various support zones are first subjected to a cleaning or scouring process in order to ensure proper bonding of the adhesive. This scouring action is obtained by the use of a method of selective chemical scouring, by means of a liquid scouring agent of any suitable known composition.

In the method according to the present invention, only those zones on which adhesive is to be applied, that is to say the central support zones 922 of the blades 971, and the main portions of the tongues 972 and 973 of the metallic support disc 16, are treated, and this treatment takes the form of chemical scouring which is localized at particular points.

The selective scouring of these zones is of course carried out regardless of the method of adhesive bonding used. In this connection, either these zones are directly coated with adhesive, or they constitute the adhesion zones for the friction liners 131 and 132, the liners having themselves been coated with adhesive beforehand.

Figure 3:
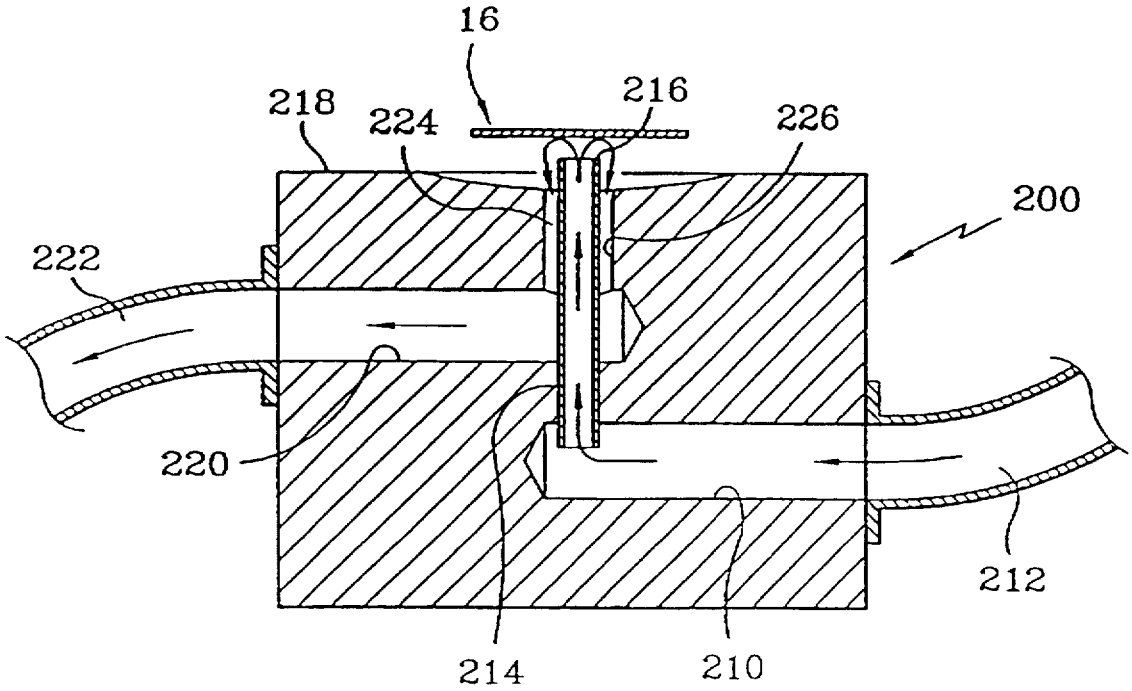
FIG. 3 is a diagrammatic view of a scouring station at which the method of chemical scouring in accordance with the invention can be carried out.

Reference is now made to FIG. 3, which shows diagrammatically the main component 200 of a selective chemical scouring station at which the method of scouring mentioned above can be carried out.

This main component 200 is in the form of a body which includes a feed duct 210 for supply of a scouring agent. The feed duct 210 is connected through a pipe 212 to a scouring solution reservoir (not shown). The feed duct 210 supplies the liquid to an inlet tube 214. The downstream free end 216 of the inlet tube 214 projects beyond the top face 218 of the body 200, so as to lie facing towards a zone to be scoured which is formed, for example as described above with reference to FIG. 2, on the surface of the annular metallic support disc 16. The latter is positioned facing towards the open end of the inlet tube 214.

This inlet tube 214 is a tube of very small diameter, of the order of millimetres, through which the liquid cleaning or washing agent can be applied in the form of successive drops which come into contact with the facing surface zone of the support disc 16, and which are held there hydrodynamically. In this way, the scouring action is localized at particular points, and the successive drops, or the drop, of the treatment liquid that is necessary for the cleaning of each particular surface zone of the support disc 16 is then recovered. For this purpose, the body 200 includes an evacuation and recovery duct 220 which is connected to a recovery pipe 222.

The recovery duct 220 is connected upstream of an annular suction portion 224, which is defined between the outer wall of the inlet tube 214 and the internal wall 226 of a hole formed in the body 200. This hole is open in the top face 218 of the body, and is coaxial with the inlet tube 214. The annular suction port 224, coaxial with the inlet tube 214, constitutes a duct for suction of the liquid cleaning agent, and for this purpose the recovery pipe 222 is connected to a recovery installation (not shown) which, in particular, includes a suction pump. It also includes, for example, a recovery tank for the cleaning solution.

As can be seen in FIG. 3, the free end 216 of the inlet tube 214 lies above the top face 218 of the body 200, that is to say above the open upper end of the suction port 224, thus enabling successive drops of the cleaning solution to make good contact before they are sucked away.

It will easily be understood how the cleaning station 200 enables the cleaning liquid to be greatly economized, this liquid being applied in the form of very small successive drops, and only on those zones which are to be cleaned. However, the liquid may be applied in the form of a continuous jet of reduced mass flow.

FIG. 3 is very diagrammatic in order to provide a simple illustration of the principle of the invention. In the case of industrial application of the method, each cleaning station can of course include a plurality of inlet tubes 214 for the cleaning agent, these inlet tubes being arranged in a pattern which corresponds to the pattern of the zones to be cleaned on one of the faces of the clutch support disc 16, or alternatively in a pattern corresponding to part of that pattern.

It is of course also possible to provide means for enabling relative displacement to take place between the support disc 16 and the station 200, so that successive different zones can be treated, or so that a zone of relatively large size can be cleaned by displacement of the free end 216 which "scans" the zone to be cleaned on the support disc 16.

It will also readily be understood that the cleaning method, consisting in the selective cleaning of certain zones of the metal support disc 16, enables it to be easily integrated into a production line for securing friction liners by adhesive bonding. Thus a station 200 can be arranged in the production line upstream of other stations, for adhesive bonding itself, without it being necessary to provide any facility for intermediate storage of the clean support discs 16.

The selective chemical cleaning method may also be associated with an electrolytic cleaning or scouring method, in which each metallic inlet tube 214 constitutes the cathode for example, with the metallic support disc 16 constituting the anode and the liquid cleaning agent being the electrolyte.

Figure 4:
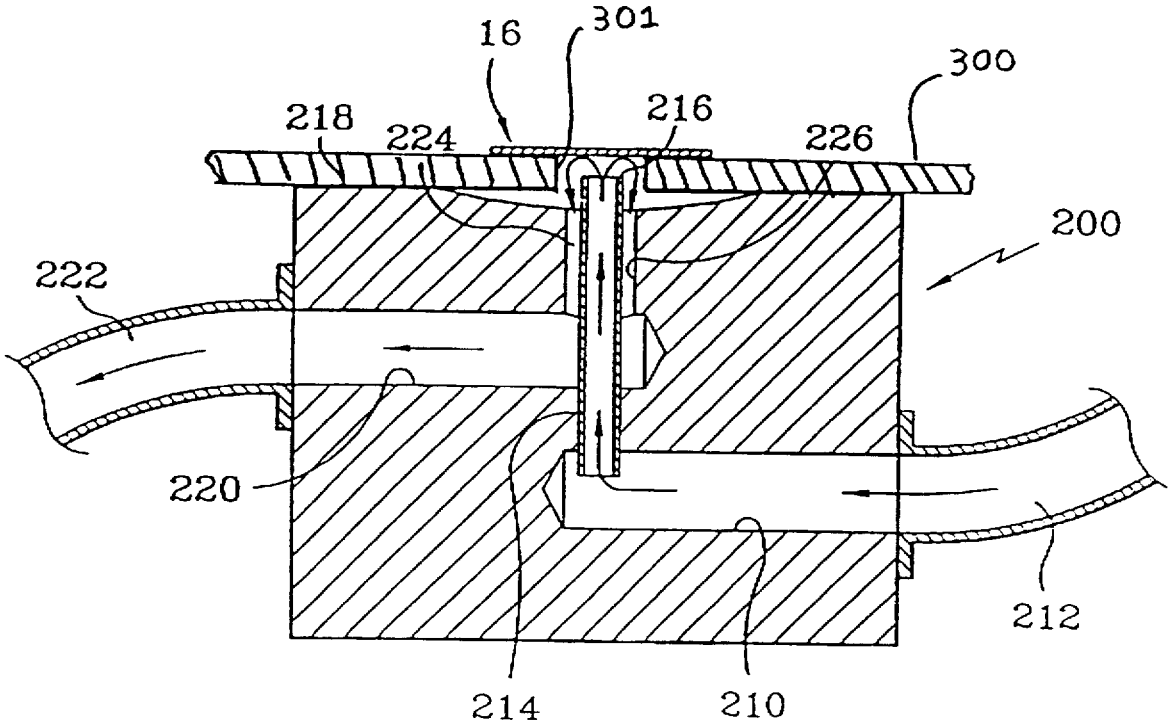
FIG. 4 is a view similar to that in FIG. 3, but shows another embodiment of the scouring station.

Reference is now made to FIG. 4, in which, by comparison with FIG. 3, a flexible plate 300, constituting a spacer, is inserted between the support disc 16 and the top surface 218 of the body 200. This plate 300 is formed with at least one through hole 301, which is centred in line with an inlet tube 214. The provision of such a spacing plate 300 enables a gap, the width of which can be modified at will, to be provided between the workpiece 16 and the cleaning station itself.

The hole 301 can be of any appropriate shape, for example circular, square and so on, that enables the zone to be treated to be adequately defined. Thus, in order to modify the spacing between the workpiece 16 and the cleaning station 200, it is merely necessary to provide a set of plates 300 of different thicknesses, and to choose the one which is most suitable for each particular application.

The flexible nature of the plate 300 also enables the zone to be treated on the workpiece 16 to be more effectively circumscribed, due to its ability to follow the profile of the surface area to be treated.

The cleaning method is of course not limited to the cleaning or scouring of metallic support discs 16 of the bladed type, but may be applied to any type of metallic support disc 16 where it is desired to clean some selected zones of the latter.

What is claimed is:

1. A method for the chemical preparation of a metallic support disc for the adhesive fastening of friction liners on the said support disc, the support disc having opposed faces each defining zones for receiving adhesive thereon, wherein the method includes the step of subjecting the said zones to selective treatment by local application of a liquid scouring agent.

2. A method according to claim 1, wherein the step of applying the liquid scouring agent consists of applying it in the form of at least one drop of said liquid scouring agent, the method further including holding the liquid hydrodynamically in contact with the said zone to be treated on the support disc.

3. A method according to claim 2, where the step of applying the scouring agent comprises applying a series of successive drops of the scouring agent to the support disc.

4. A method according to claim 1, wherein the step of applying the scouring agent comprises applying a low mass flow, narrow jet of the said liquid agent to the said zone of the support disc, the method further including removing the scouring agent by suction from the periphery of the said zone.

5. A method according to claim 1, using apparatus comprising an inlet tube having a free end, and means for mounting the support disc to be treated close to and in facing relationship with said free end of the inlet tube, the method including the further steps, prior to application of the scouring agent, of connecting said end of the inlet tube electrically so that the latter constitutes an electrode, and connecting the support disc so that the support disc acts as another electrode, the step of applying the scouring agent being an electrolytic step in which the scouring agent acts as an electrolyte, the electrodes being energized so that the scouring agent is directed on to said zone to be treated on the support disc.

6. A workstation for the performance of a method according to claim 1 at the workstation, wherein the workstation comprises at least one inlet tube for delivering said liquid scouring agent to the zones of the support disc to be treated, and recovery means for removing said scouring agent by suction.

7. A workstation according to claim 6, wherein the said recovery means include an annular suction port coaxial with the inlet tube.

8. A workstation according to claim 6, further including means for displacing the support disc with respect to the inlet tube by rotation, whereby to enable the said zones on a face of the support disc to be treated.

9. A workstation according to claim 6, having a plurality of said inlet tubes arranged in a pattern corresponding to the pattern of selected said zones of the support disc.

10. A workstation according to claim 6, comprising a body having a surface, said inlet tube having an exit end adjacent to said surface, the workstation further including a plate having at least one through hole, the plate being disposed between the support disc and said surface of the body.

11. A workstation according to claim 10, wherein the said plate is flexible.

12. A workstation according to claim 11, wherein the said through hole is centred with respect to the inlet tube.

13. A workstation according to claim 10, wherein the said through hole is disposed in line with a said inlet tube.

14. An installation for the adhesive fastening of friction liners on a metallic support disc, including at least one workstation according to claim 6 and an adhesive fastening station downstream of the said at least one workstation.

* * * * *